US007597199B1

(12) United States Patent
Rochelo

(10) Patent No.: US 7,597,199 B1
(45) Date of Patent: Oct. 6, 2009

(54) BATTERY TUBE STORAGE SYSTEM, SYSTEM CONTAINER, AND CONTAINER LATCH-LOCK

(76) Inventor: Donald R. Rochelo, 323 Red Barn Rd., Dalton, MA (US) 01226

( * ) Notice: Subject to any disclaimer, the term of this patent is extended or adjusted under 35 U.S.C. 154(b) by 778 days.

(21) Appl. No.: 11/146,172

(22) Filed: Jun. 6, 2005

Related U.S. Application Data

(60) Provisional application No. 60/577,646, filed on Jun. 7, 2004.

(51) Int. Cl.
*B65D 85/00* (2006.01)

(52) U.S. Cl. ..... 206/703; 429/96

(58) Field of Classification Search ..... 206/703, 206/704, 705, 560, 507, 775, 776, 443, 446; 429/96, 97, 98, 99, 100, 9, 159; 220/507, 220/4.21, 4.24, 23.2–23.8, 4.26; D13/103
See application file for complete search history.

(56) References Cited

U.S. PATENT DOCUMENTS 2,465,644 A * 3/1949 Graves ..... 220/507
3,338,452 A * 8/1967 Oakley et al. ..... 220/23.4
4,757,894 A * 7/1988 Schreckenstein ..... 206/3
5,075,182 A * 12/1991 Weber ..... 429/96
5,402,903 A * 4/1995 Mann ..... 220/23.6
6,102,232 A * 8/2000 Lin et al. ..... 220/23.4
6,230,885 B1 5/2001 Rochelo
6,419,091 B1 * 7/2002 Gaffney et al. ..... 206/703
6,456,038 B1 * 9/2002 Anton et al. ..... 320/107
6,739,452 B2 5/2004 Rochelo
2002/0127468 A1 * 9/2002 Wani et al. ..... 429/96

* cited by examiner

*Primary Examiner*—Bryon P Gehman
*Assistant Examiner*—Ernesto A Grano
(74) *Attorney, Agent, or Firm*—Malcolm J. Chisholm, Jr.

(57) ABSTRACT

A battery tube storage system (10) includes a first container (12) having a first light transmitting, rigid shell (14) including a first color, such as green, that defines a plurality of tubes (16A, 16B, 16C, 16D) dimensioned to receive and secure cylindrical shaped batteries (24). A first latch-lock (26) secures a top (22) to an entry-end (20) of the first shell (14). A similar second shell (32) is made of or includes a second color that is distinct from the first color, such as red. The first shell (14) can be detachably secured to the second shell (32) so that the battery storage system (10) may be used to carry varying numbers of batteries (24) depending upon the needs of a user, and by the distinct colors, a user can quickly distinguish between used and unused batteries (24).

6 Claims, 6 Drawing Sheets

BATTERY TUBE STORAGE SYSTEM, SYSTEM CONTAINER, AND CONTAINER LATCH-LOCK

CROSS REFERENCE TO RELATED APPLICATION

This Application claims the benefit of U.S. Provisional Patent Application Ser. No. 60/577,646 that was filed on Jun. 7, 2004, entitled "Battery Tube Storage System, System Container, and Container Latch-Lock".

TECHNICAL FIELD

The present invention relates to a battery storage system for safely storing and quickly identifying contents and quality of cylindrical shaped batteries, such as known "AA" sized batteries.

BACKGROUND ART

Dry cell batteries are well known for providing a source of electrical current for common, household items such as flashlights, portable audio tape and compact disc players, cameras, etc., and it is well known that such dry cell batteries are available in common sizes and voltages. Small cylindrical batteries known as sizes "AA" and "AAA" are increasingly common for supplying electrical current to a vast array of consumer devices such as remote control devices, video games, portable compact disk players, radios, flashlights, etc. Because of the prevalence of those battery sizes and their multiple uses, more costly rechargeable batteries are commonly available in the same sizes.

Typically, such batteries are sold in a light transmitting, see-through package that houses two to twelve of the batteries in a cluster that is efficiently prepared for retail display in stores. However, once a user opens such a package and extracts some of the batteries, the package is no longer an efficient storage device because batteries may move about and fall out of the package to be lost, and it is difficult to know how many batteries remain within such opened retail display packages. For rechargeable batteries, or used batteries in need of proper disposal, it is very difficult to determine which battery holds a charge, and which needs to be re-charged or discarded if the batteries are stored in known battery storage containers.

Accordingly, there is a need for an efficient battery storage system that provides a safe, electrical-discharge proof case that isolates the batteries from accidental contact with each other and with conductive materials; that provides a user with quick identification of how many batteries are stored in the container, what size batteries are being stored, and for rechargeable batteries, how many of the stored batteries may need recharging, and how many are ready to use; and, that is easy and safe to carry within a user's shirt pocket.

SUMMARY OF THE INVENTION

The invention is a battery tube storage system that includes a first container having a first light transmitting, rigid shell including a first color, such as a translucent plastic container colored green. The first shell defines a plurality of tubes or partial tubes extending between a base-end and an opposed entry-end of the first shell. The plurality of tubes or partial tubes are dimensioned to receive and secure cylindrical shaped batteries, such as "AA" or "AAA" sized batteries. The first container includes a top secured to the entry-end for enclosing one or more batteries within the plurality of tubes. A first latch-lock selectively secures the top to the entry-end of the first shell.

The storage system includes a nearly identical second container having a second light transmitting, rigid shell. However, the second shell is made of or includes a second color that is distinct from the first color, such as a translucent plastic container colored red. The second shell defines a plurality of tubes or partial tubes extending between a base-end and an opposed entry-end of the second shell. The second container also includes a top secured to the entry-end for enclosing one or more batteries within the plurality of tubes and a second latch-lock selectively secures the top to the entry-end of the second shell. The first shell can be detachably secured to the second shell by securing structures, such as structures at the base ends of the first and second shells, so that the battery storage system may be used to carry varying numbers of batteries depending upon the needs of a user.

In a preferred embodiment, the first shell is dimensioned to hold four "AA" sized batteries, and the second shell is likewise dimensioned to hold four "AA" sized batteries. If the batteries are rechargeable, then those batteries holding a charge and ready to use may be secured in the first or green colored container, while those batteries needing a recharge may be secured within the second or red colored container.

By securing the containers to each other by a "tongue and groove" type of structure at the respective base ends, the battery storage system provides an efficient, shirt-pocket sized arrangement for storing batteries. In a preferred embodiment the first and second shells include lock shoulders that are defined to extend respectively along about one-half of the base ends of their shells so that both the first and second shells may be efficiently manufactured from a single mold.

In such a preferred arrangement, some batteries are almost always exerting by force of gravity a load upon one of the tops, and because of the natural flexibility, or limited elastic nature of light plastic containers, it was found that traditional plastic, single-mold latch structures resulted in an unacceptable amount of accidental openings of the tops of the containers. Therefore, the battery storage system of the present invention includes a latch-lock that provides remarkably efficient locking of the containers of the system against accidental opening. The latch-lock includes a latch tab extending from the top of the container and having a tab protrusion dimensioned to engage a lock shoulder defined at an entry-end of the container adjacent the container top. A pair of opposed lock pillars extend from the lock shoulder and are positioned to be adjacent side edges of the latch tab and to overly a portion of the top whenever the latch tab engages the lock shoulder to close the top of the container. The lock pillars serve to prevent motion of the container inward away from the latch tab, and thereby secure the top against accidental opening. The container latch-lock may be used for storing batteries or any object that could fit within the battery container or known containers.

Accordingly, it is a general purpose of the present invention to provide a battery tube storage system, system container, and container latch-lock that overcomes deficiencies of the prior art.

It is a more specific purpose to provide a battery tube storage system, system container, and container latch-lock that provides for secure storage and ready identification of dry-cell batteries while protecting the batteries against accidental loss and discharge.

It is yet another purpose to provide a battery tube storage system, system container, and container latch-lock that enables a user to quickly identify a number of charged batteries and batteries needing a charge or needing disposal that are stored within the system.

These and other purposes and advantages of the present color-coded battery storage system will become more readily apparent when the following description is read in conjunction with the accompanying drawing.

DESCRIPTION OF THE PREFERRED EMBODIMENTS

Figure 1:
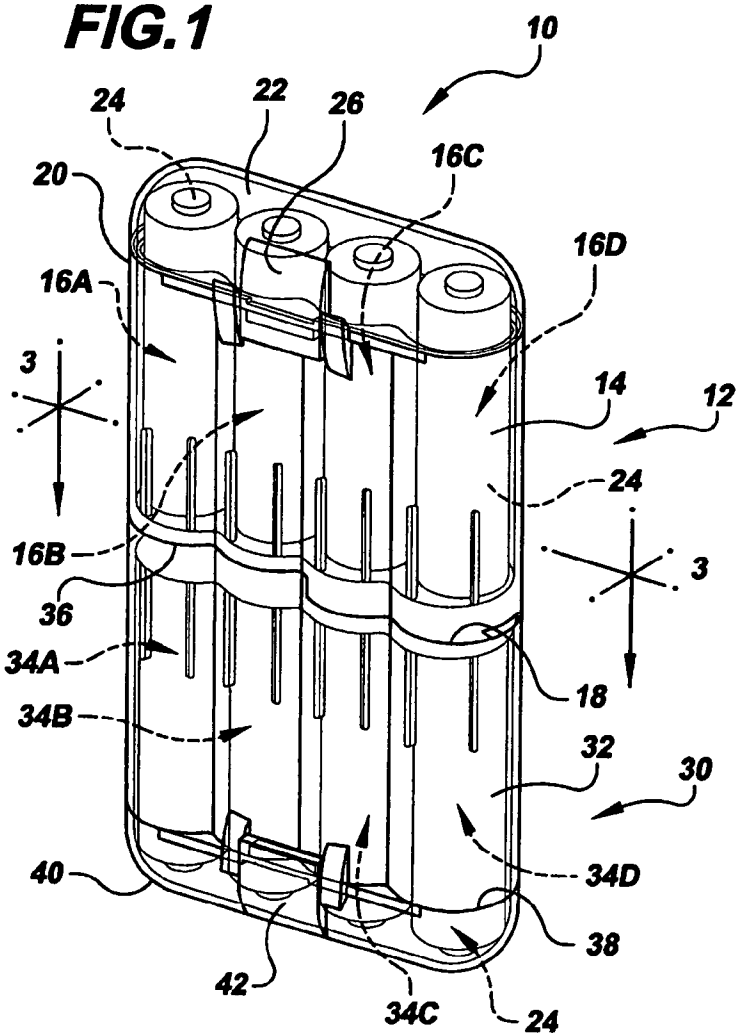
FIG. 1 is a perspective view of a battery tube storage system, system containers, and container latch-locks constructed in accordance with the present battery tube storage system.

Referring to the drawings in detail, a battery tube storage system constructed in accordance with the present invention is shown in FIG. 1, and is generally designated by the reference numeral 10. The system includes a first container 12 having a first rigid shell 14 that may be light transmitting. The first container includes a first color such as green. For purposes herein, the phrase "including a . . . color" is to mean that the entire container 12 or a portion thereof exhibits the specified color. The portion of the container 12 that exhibits the color maybe as much as all of the container 12, or as little as a color label (not shown) attached to the container 12. In a preferred embodiment, the first container 12 may be a light transmitting, translucent green color. The first container 12 may also include only a portion that is light transmitting, such as a strip to view contents of the container 12, or may be completely opaque. The first shell 14 defines a plurality of tubes 16A, 16B, 16C, 16D or partial tubes extending between a base-end 18 and an opposed entry-end 20 of the first shell 14. The first container 12 also includes a top 22 secured to the entry-end 20 of the shell 14 for enclosing one or more batteries 24 within the tubes 16A, 16B, 16C, 16D. A first latch-lock 26 is secured to the first container 12 for selectively securing the top 22 to the entry-end 20 of the first shell 14. By use of the word "selectively" with respect to the latch-lock 26, it is meant that a user may use the first latch-lock 26 to select to have the top 22 of the container 12 in either an open or closed position.

The system 10 also includes a second container 30 having a second rigid shell 32 that may be light transmitting, and includes a second color that is distinct from the first color, such as red. The second shell 32 defines a plurality of tubes 34A, 34B, 34C, 34D or partial tubes extending from a base-end 36 to an opposed entry-end 38 of the second shell 32 dimensioned to house and secure a plurality of batteries 24, as shown in FIG. 1. The second container 30 also includes a top 40 for enclosing one or more batteries 24 within the tubes 34A, 34B, 34C, 34D. A second latch-lock 42 is secured to the second container 14 for selectively securing the top 40 to the entry-end 38 of the second shell 32.

Figure 2:
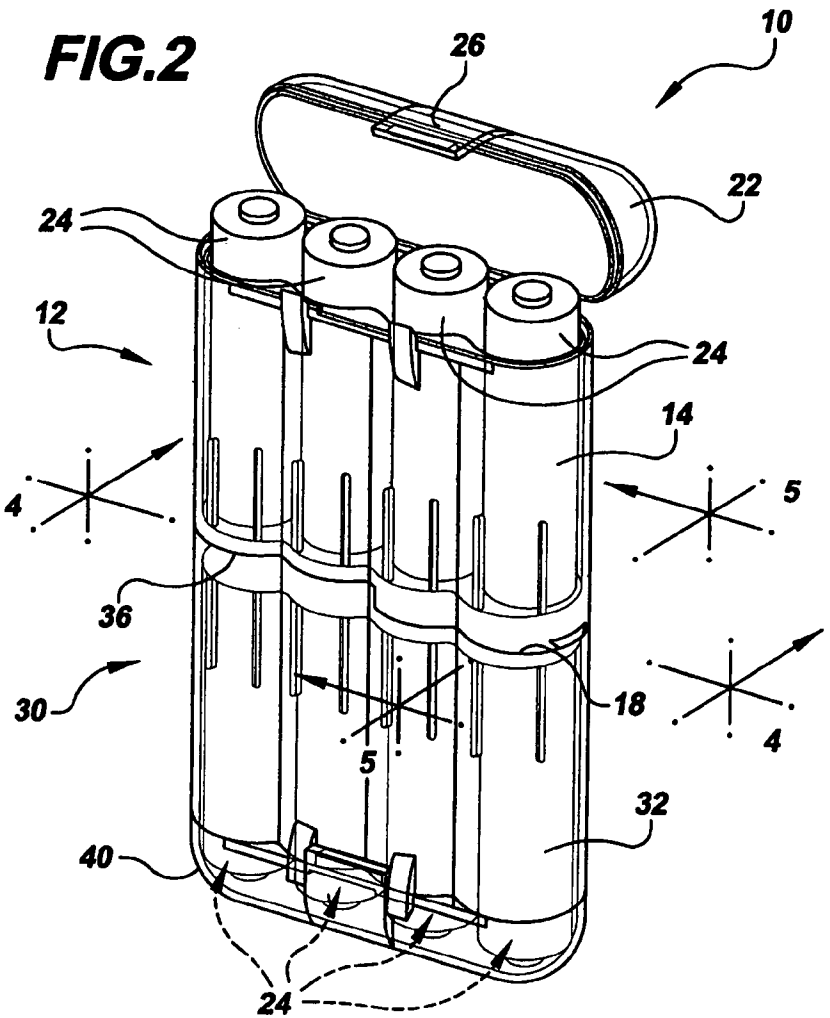
FIG. 2 is a perspective view of the battery tube storage system of FIG. 1, showing a top of a container opened.
Figure 3:
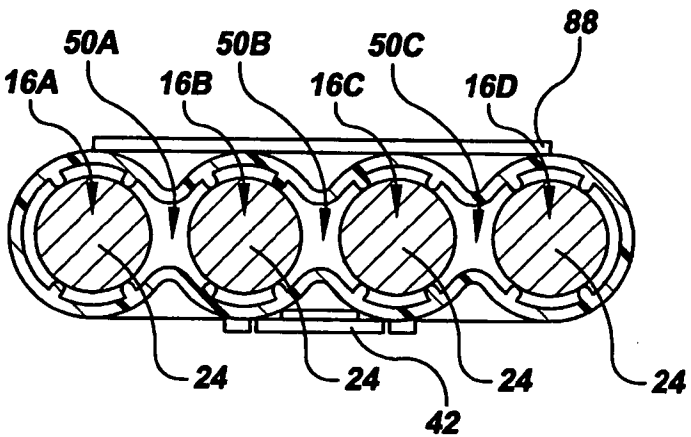
FIG. 3 is a cross-section view of the FIG. 1 battery tube storage system taken along view lines 3-3 of FIG. 1.

FIG. 2 shows the FIG. 1 battery tube system 10 with the first container 12 having its top 22 opened to emphasize the facility with which a user may extricate the batteries 24 from the first shell 14. FIG. 3 shows the batteries 24 within the plurality of tubes 16A, 16B, 16C, 16D, wherein the tubes are partial, meaning there may be voids 50A, SOB, 50C between adjacent batteries 24 for efficiency, rather than complete walls for each tube 16A, 16B, 16C, 16D.

Figure 4:
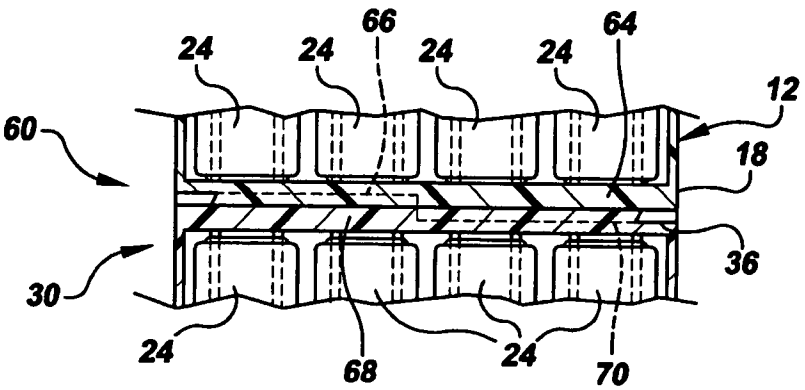
FIG. 4 is a fragmentary cross-section view of the battery tube storage system of FIG. 1 taken along view lines 4-4 of FIG. 2.
Figure 5:
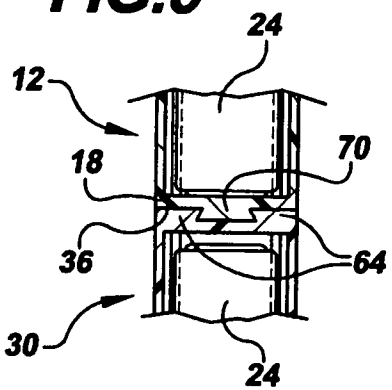
FIG. 5 is a fragmentary cross-section view of the battery tube storage system of FIG. 1 taken along view lines 5-5 of FIG. 2.
Figure 6:
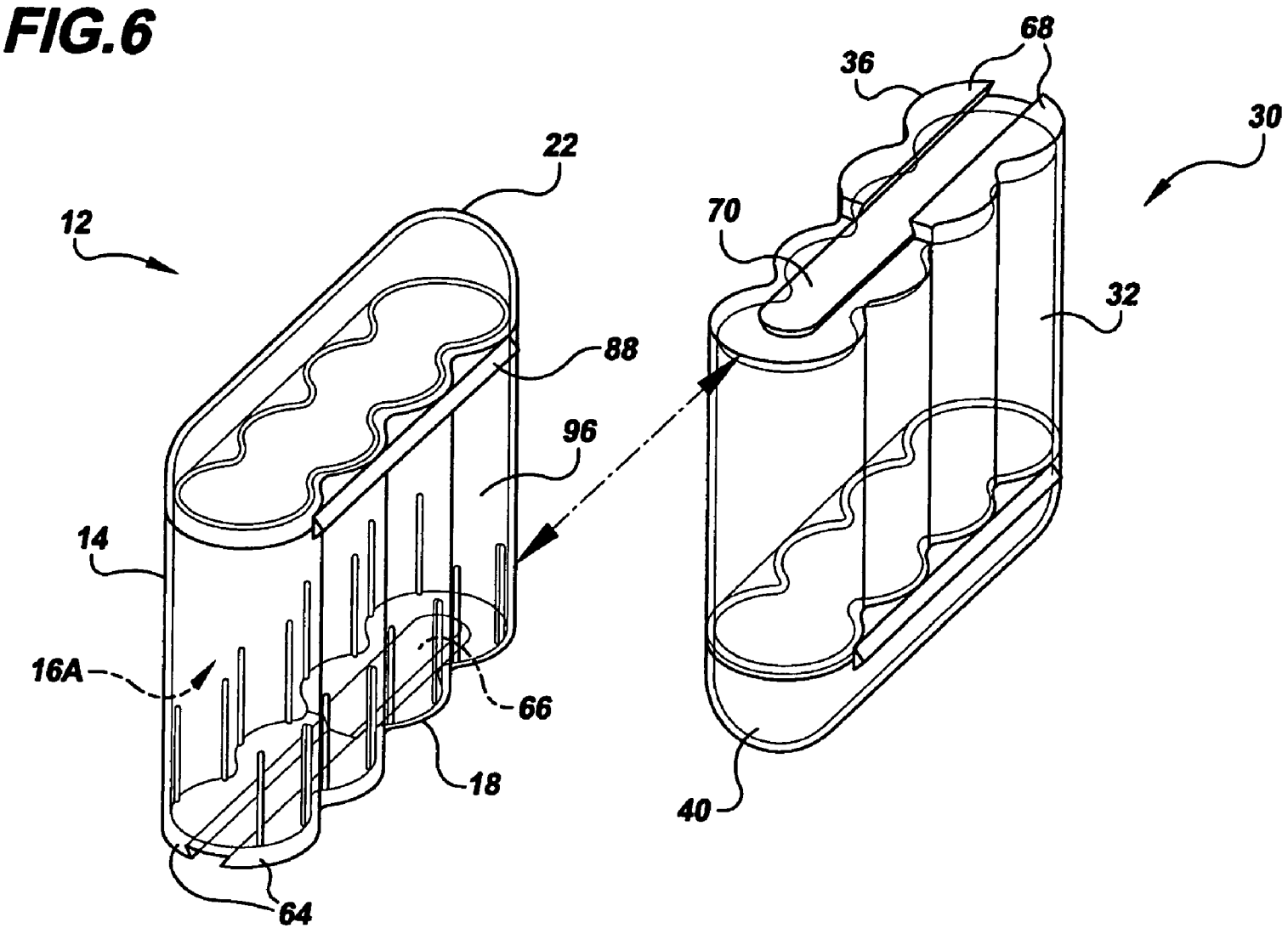
FIG. 6 is a rear perspective view of the FIG. 1 battery tube storage system showing a first container separated from a second container.
Figure 7:
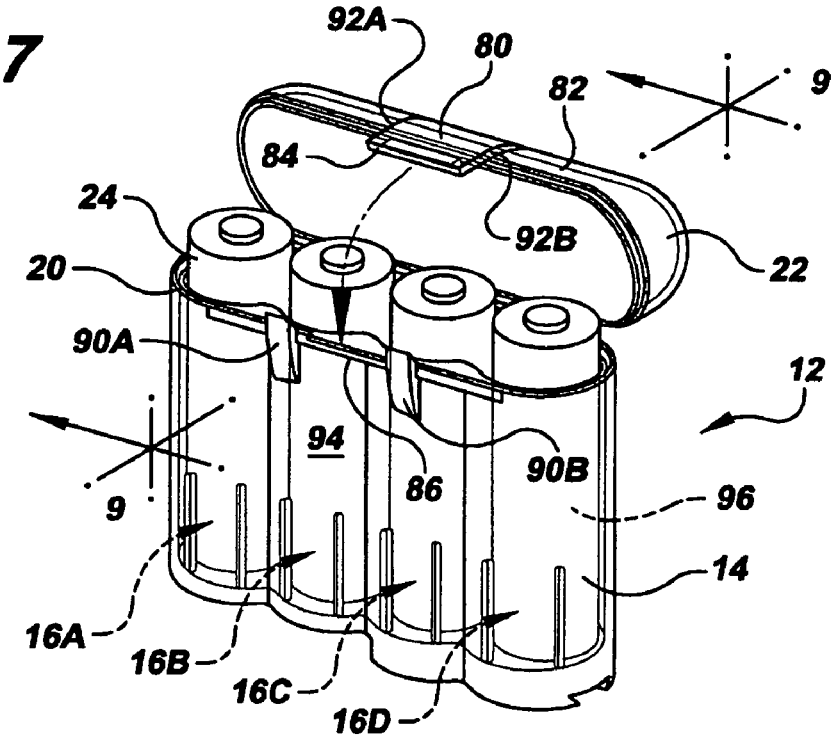
FIG. 7 is a perspective view of a first container of the FIG. 1 battery storage system showing a top open.
Figure 8:
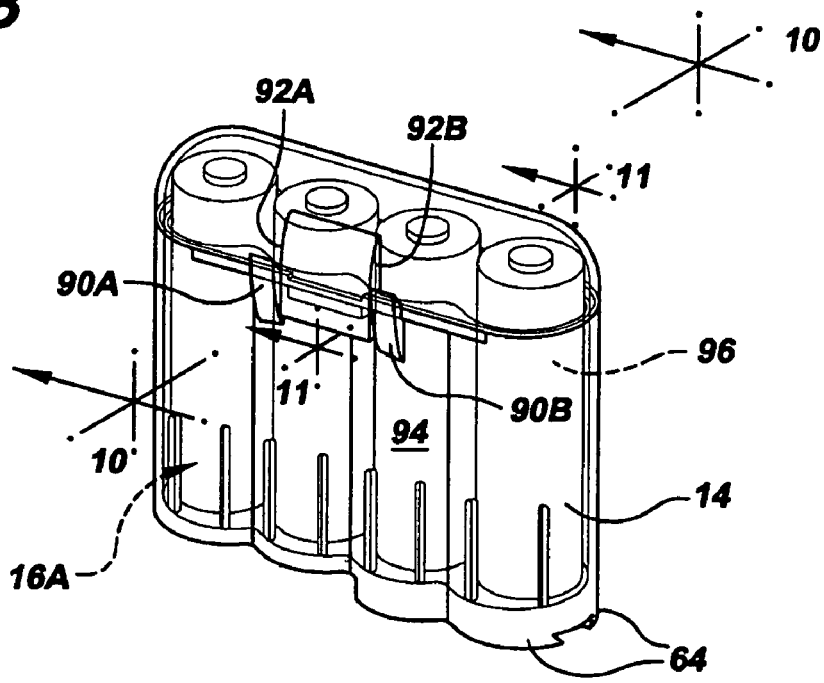
FIG. 8 is a perspective view of the first container of the FIG. 1 battery storage system showing the top closed.
Figure 9:
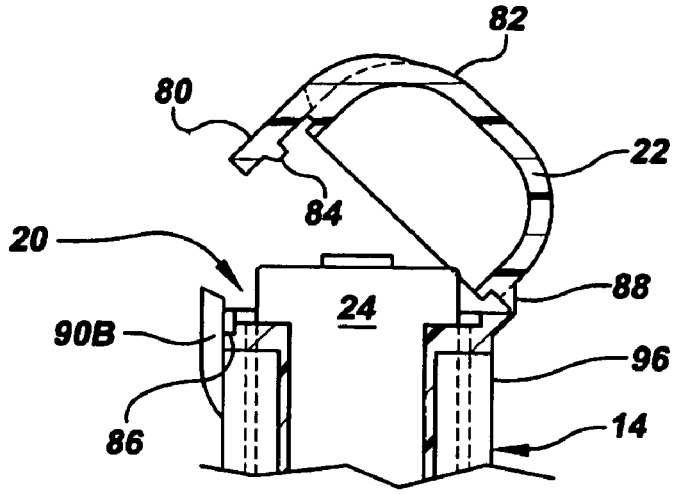
FIG. 9 is a cross section of the container shown in FIG. 7, taken along view lines 9-9 of FIG. 7.
Figure 10:
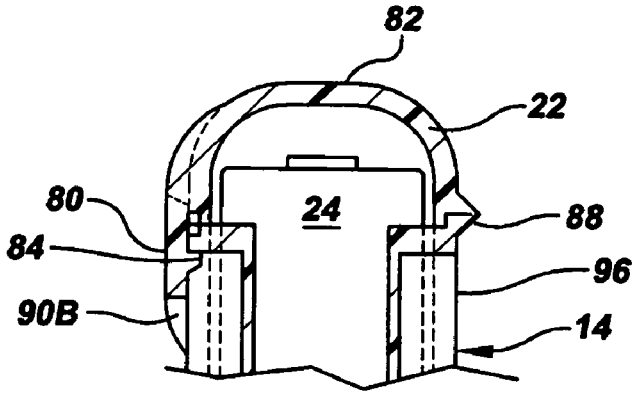
FIG. 10 is a cross section of the container shown in FIG. 8, taken along view lines 10-10 of FIG. 8.
Figure 11:
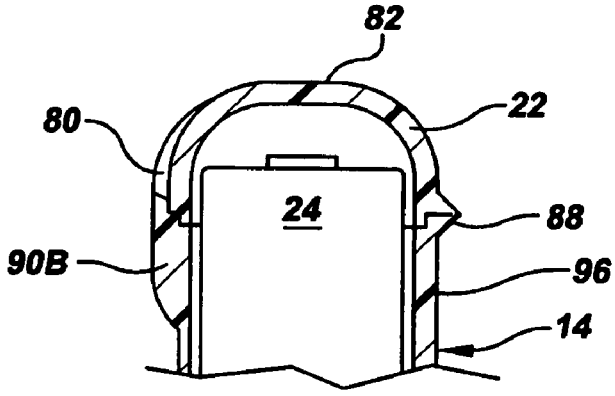
FIG. 11 is a cross section of the container shown in FIG. 8 taken along view lines 11-11 of FIG. 8.

FIGS. 4-6 show a securing means 60 for detachably securing the first container 12 to the second container 30. The securing means 60 may also include any structure known in the art for securing small containers to each other so that picking up one container causes the other container to be picked up as well. Such known securing means include side-by-side securing, such as elastic bands, snaps, hook-and-loop ("VEL-CRO") bands and patches, and base-end to base-end securing structures, etc. A preferred securing means 60 includes at the base-end 18 of the first shell 14 a first pair of opposed lock shoulders 64 and a first lock tongue 66 extending from the opposed first pair of lock shoulders 66 along the base-end 18 of the first shell 14. The preferred securing means 60 also includes at the base-end 36 of the second shell 30 a second pair of opposed lock shoulders 68 and a second lock tongue 70 (seen best in FIG. 6) extending from the second pair of opposed lock shoulders 68 and extending along the base-end 36 of the second shell 32. The first and second pairs of opposed lock shoulders 64, 66 and first and second lock tongues 66, 70 are cooperatively dimensioned so that the first lock tongue 66 slides into and between the second pair of opposed lock 68 shoulders while the second lock tongue 70 slides into and between the first pair of opposed lock shoulders 64 to secure the first container 12 to the second container 30.

The preferred securing mean 60 appears to be a somewhat common "tongue and groove" securing structure. However, in a preferred embodiment as shown in FIGS. 4-6, the first lock shoulders 64 extend along about one-half of a length of the base end 18 of the first container 12. (For purposes herein, the word "about" means plus or minus ten percent.) Similarly, the second lock shoulders 68 extend along about one-half of the base end 36 of the second container 30. This cooperative arrangement of a preferred embodiment of the securing means 60 provides for production of both the first container 12 and the second container 30 from a single plastic manufacturing mold (not shown), which significantly enhances manufacturing efficiency. Also, by having the two pairs of opposed lock shoulders 64, 68 extend from an end to about one-half of the length of their respective base-ends 18, 36, the pairs of lock shoulders 64, 70 abut each other mid-way along the lengths of the base ends 18, 36 when the first and second containers 12, 30 are secured together. Therefore, when the containers 12, 30 are united as the battery storage system 10, they are neatly secured together with no ridges or bumps between the first and second containers 12, 30, as shown in FIGS. 1 and 2. This smooth alignment provides a very neat, compact, and tightly secured system 10 detachably securing the first and second containers 12, 30 together.

FIGS. 7-11 show details of the first container 12 and its first latch-lock 26. It is stressed that the tops 22, 40 of the first and second containers 12, 30 may be secured by any latch means known in the art for selectively closing any securing top to a container having an enclosure capable of containing one or more batteries. The inventor herein, however, faced with the problem described above of securely closing a top of an upside down battery container (e.g., the second container 30 as shown in FIG. 1), and needing to make such a secure latch structure in a single plastic manufacturing mold, invented a preferred latch means in the form of the first latch-lock 26 shown best in container FIGS. 7-11.

The first latch-lock 26 includes a latch tab 80 extending from an outside surface 82 of the top 22 of the first container 12 in a direction toward the entry-end 20 of the first shell 14. The latch tab 80 includes a tab-protrusion 84 (best seen in FIG. 9) dimensioned to slide over and engage a lock shoulder 86 (best seen in FIGS. 7 and 9) defined at the entry-end 20 of the first shell 14 so that the latch tab 80 must be moved in a direction away from the lock shoulder 86 and plurality of tubes 16A, 16B, 16C, 16D to permit pivoting of the top 22 away from the entry-end 20 to open the top 22. The top 22 is also pivotally secured to the first shell 14 by a hinge 88 (shown best in FIGS. 6, and 9-11). The latch-lock also includes at lest one and preferably a pair of opposed lock pillars 90A, 90B extending from the lock shoulder 86 away from the entry-end 20 of the first shell 14 in a direction toward the top 22 and positioned on the lock shoulder 86 to be adjacent opposed side edges 92A, 92B of the latch tab 80 whenever the tab-protrusion 84 engages the lock shoulder 86. The lock pillars 90A, 90B overlie a portion of the top 22 adjacent the latch tap 80 so that the lock pillars 90A, 90B prohibit disengagement of the tab-protrusion 84 from the lock shoulder 86 by compression of a front surface 94 of the first shell 14 toward an opposed back surface 96 of the first shell, to thereby lock the top 22 to the entry-end 20 of the first shell against accidental opening of the top 22.

The second latch-lock 42 could be the same as the preferred first latch-lock 26. Additionally, the latch means includes the described first latch-lock 26 arranged inversely on the first container 14, so that an inverse latch tab (not shown) extends from the entry-end 20 of the first shell 14 to engage a lock shoulder (not shown) on the top 22, and lock pillars (not shown) extend from the top 22 of the first container 12 to secure such a latch tab against unintended disengagement from the lock shoulder.

The preferred first latch-lock 26 minimizes accidental disengagement of the tab protrusion 84 from the lock shoulder 86 by either compressive forces moving the front surface 94 toward the back surface 96, or by any linear force extending along the front surface 94 of the container 12 to impact the latch tab 80, such as by sliding the container 12 so that an object impacts the latch tab 80. In those circumstances, the lock pillars 90A, 90B force compression of both the front surface 94 and the top 22 together so that the tab protrusion 84 remains engaged with the lock shoulder 86. The only way the tab protrusion 84 may be disengaged from the lock shoulder 86 is by a positive movement of the latch tab 80 away from the front surface 94 and the top 22, such as by bending the latch tab 80 with a user's finger (not shown) away from the front surface 94 and the top 22. Consequently, the first latch-lock 26 provides a very secure closure of the top 22 to the entry-end 20 of the shell 14 of the first container 12.

Figure 12:
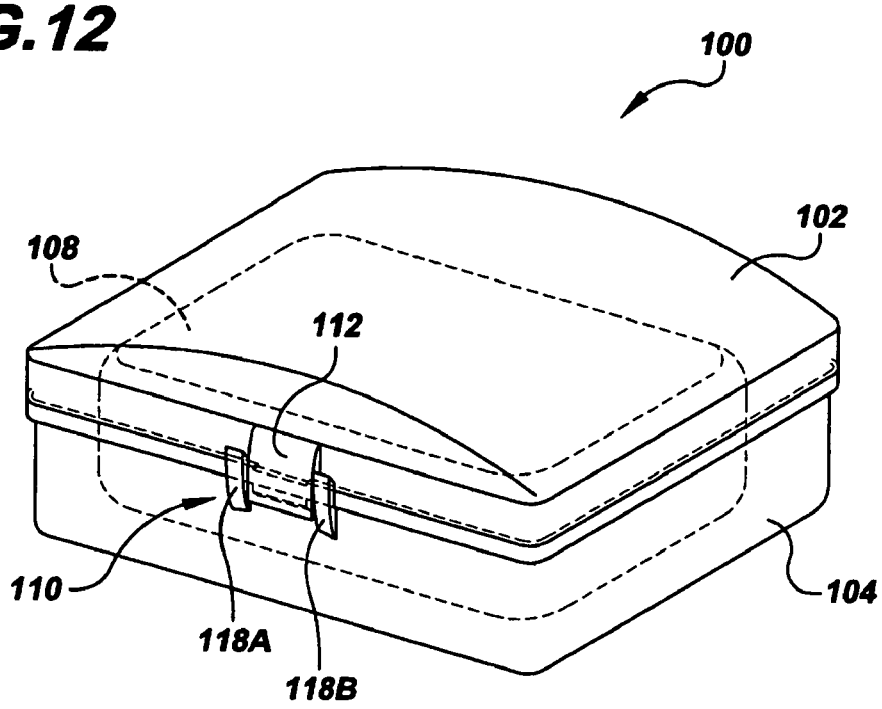
FIG. 12 is a perspective view of a container having a latch-lock of the present invention, showing a top of the container closed.
Figure 13:
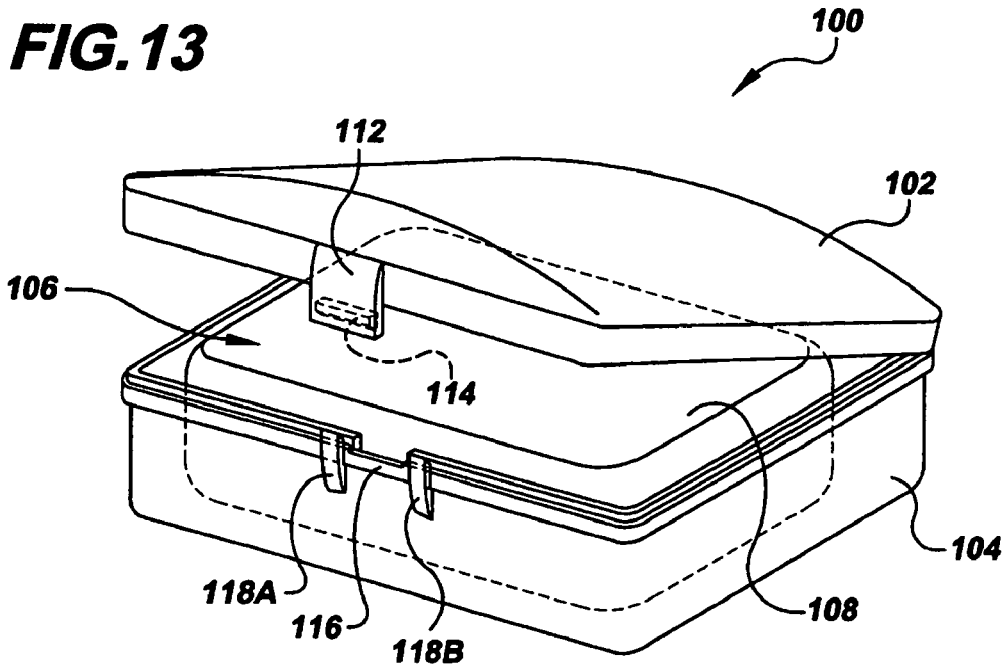
FIG. 13 is a perspective view of the container of FIG. 12, showing the top open.

The preferred first latch-lock 26 is so secure that it may be adapted to provide for secure closure of an ordinary container 100 (shown in FIGS. 12 and 13) having a top 102 pivotally secured to a shell 104 defining a containment chamber 106 between the top 102 and shell 104 capable of containing any shaped object 108, such as a bar of soap 108, or a rectangular shaped battery, etc. A container latch-lock 110 secured to the ordinary container 100 includes the same components described above, namely, a second latch tab 112 extending from the top 102 and having a tab protrusion 114 that engages a second lock shoulder 116, and at least one and preferably a second pair of lock pillars 118A, 118B extending from the shell 104 that overlie the top 102 and are positioned adjacent the second latch tab 112 whenever the second tab protrusion 114 engages the second lock shoulder 116. Again, the inventive latch-lock 26 provides for secure, durable latching of the top 102 to the shell against accidental opening in a common container 100 wherein the container 102 and container latch-lock 110 can be made in a single plastic manufacturing mold (not shown).

As described above, the container latch-lock 110 may be constructed inversely (not shown) so that the second latch tab 112 extends from the shell 104 of the container 100, and the lock pillars 118A, 118B extend from the top 102 of the container. Both the illustrated embodiments of the first latch-lock 26, the container latch lock 110 and the described inverse arrangement may be characterized as the container 100 having the top 102 pivotally secured to the shell 104, and having a latch-lock 110 for selectively securing the top 102 to the shell 104, the latch-lock 110 including a latch tab 112 extending from one of either the top 102 or the shell 104, and at least one lock pillar 118A extending from the other of either the top 102 or the shell 104 of the container 100, wherein the latch tab 112 includes a tab protrusion 114 that engages a lock shoulder 116 defined adjacent the lock pillar 118A to secure the top 102 adjacent the shell 104, and wherein the lock pillar 118A extends adjacent to the latch tab 112 and overlies the top 102 or the shell 104 from which the latch tab 80 extends whenever the tab protrusion 114 engages the lock shoulder 116 to secure the top 102 adjacent the shell 104.

The present invention also includes a system container 12, like the first container 12 alone, configured to include the first latch-lock 26 and the plurality of tubes 16A, 16B, 16C, 16D. Such a system container 12 alone may present a convenient and secure battery storage container 12. The system container 12 may be made completely of a light transmitting material, such as a translucent plastic, may include only a small light transmitting portion, or may be completely opaque. Also, the system container 12 may or may not have a distinctive color.

While the present invention has been disclosed with respect to the described and illustrated embodiments, it is to be understood that the invention is not to be limited to those embodiments. Accordingly, reference should be made primarily to the following claims rather than the foregoing description to determine the scope of the invention.

What is claimed is:

1. A battery tube storage system (10) comprising:

a. a first container (12) having a first rigid shell (14) the first container (12) including a first color, the first shell (14) defining a plurality of tubes (16A, 16B, 16C, 16D) extending between a base-end (18) and an opposed entry-end (20) of the first shell (14), the first container (12) including a top (22) secured to the entry-end (20)

for enclosing one or more batteries (24) within the plurality of tubes (16A, 16B, 16C, 16D) and a first latch means for selectively securing the top (22) to the entry-end (20) of the first shell (14);

b. a second container (30) having a second rigid shell (32), the second container (30) including a second color distinct from the first color, the second shell (32) defining a plurality of tubes (34A, 34B, 34C, 34D) extending between a base-end (36) and an opposed entry-end (38) of the second shell (32), the second container (30) including a top (40) secured to the entry-end (38) of the second shell (32) for enclosing one or more batteries (24) within the plurality of tubes (34A, 34B, 34C, 34D) and a second latch means for selectively securing the top (40) to the entry-end (38) of the second shell (32); and, c. securing means (60) for detachably securing the first container (12) to the second container (30), wherein the securing means (60) includes a first pair of opposed lock shoulders (64) at the base-end (18) of the first shell (14) and a first lock tongue (66) extending from the first pair of opposed lock shoulders (64) along the base-end (18) of the first shell (14), and the securing means (60) also includes a second pair of opposed lock shoulders (68) at the base-end (36) of the second shell (32) and a second lock tongue (70) extending from the second pair of opposed lock shoulders (68) along the base-end (36) of the second shell (32), the first and second pairs of opposed lock shoulders (64, 68) and first and second lock tongues (66, 70) being cooperatively dimensioned so that the first lock tongue (66) slides into and between the second pair of opposed lock shoulders (68) while the second lock tongue (70) slides into and between the first pair of opposed lock shoulders (64) to secure the first container (12) to the second container (30), and wherein the first pair of lock shoulders (64) extends along about one-half of a length of the base end (18) of the first container (12) and the second pair of lock shoulders (68) extends along about one-half of a length of the base end (36) of the second container (30).

2. The battery tube storage system (10) of claim 1, wherein the first container (12) is light transmitting and the second container (30) is light transmitting.

3. The battery tube storage system (10) of claim 1, wherein the first container (12) includes the color green and the second container (30) includes the color red.

4. A battery tube storage system (10) comprising:

a. a first container (12) having a first rigid shell (14) the first container (12) including a first color, the first shell (14) defining a plurality of tubes (16A, 16B, 16C, 16D) extending between a base-end (18) and an opposed entry-end (20) of the first shell (14), the first container (12) including a top (22) secured to the entry-end (20) for enclosing one or more batteries (24) within the plurality of tubes (16A, 16B, 16C, 16D) and a first latch means for selectively securing the top (22) to the entry-end (20) of the first shell (14);

b. a second container (30) having a second rigid shell (32), the second container (30) including a second color distinct from the first color, the second shell (32) defining a plurality of tubes (34A, 34B, 34C, 34D) extending between a base-end (36) and an opposed entry-end (38) of the second shell (32), the second container (30) including a top (40) secured to the entry-end (38) of the second shell (32) for enclosing one or more batteries (24) within the plurality of tubes (34A, 34S, 34C, 34D) and a second latch means for selectively securing the top (40) to the entry-end (38) of the second shell (32);

c. securing means (60) for detachably securing the first container (12) to the second container (30); and, d. wherein the first latch means includes a first latch-lock (26) comprising a latch tab (80) extending from the top (22) of the first container (12) in a direction toward the entry-end (20) of the first shell (14), the latch tab including a tab-protrusion (84) dimensioned to slide over and engage a lock shoulder (86) defined at the entry-end (20) of the first shell (14) so that the latch tab (80) must be moved in a direction away from the lock shoulder (86) and plurality of tubes (16A, 16B, 16C, 16D) to permit pivoting of the top (22) away from the entry-end (20) of the first shell (14) to open the top (22), the latch-lock (26) also including at least one lock pillar (90A) extending from the lock shoulder (86) away from the entry-end (20) of the first shell (14) in a direction toward the top (22) and positioned to overlie the top (22) and to be adjacent the latch tab (80) whenever the tab-protrusion (84) engages the lock shoulder (86) so that the lock pillar (90A) prohibits disengagement of the tab-protrusion (84) from the lock shoulder (86) by compression of a front surface (94) of the first shell (14) toward an opposed back surface (96) of the first shell (14) to lock the top (22) to the entry-end (20) of the first shell (14) against accidental opening of the top (22).

5. The battery tube storage system container (12) of claim 4 wherein the container (12) is light transmitting.

6. The battery tube storage system (10) of claim 4, wherein the first container (12) includes the color green and the second container (30) includes the color red.

* * * * *